US009186915B2

(12) United States Patent
Hasebe et al.

(10) Patent No.: US 9,186,915 B2
(45) Date of Patent: Nov. 17, 2015

(54) DRYING DEVICE AND IMAGE FORMING APPARATUS

(71) Applicant: FUJI XEROX CO., LTD., Tokyo (JP)

(72) Inventors: Satoshi Hasebe, Kanagawa (JP); Norio Hokari, Kanagawa (JP); Hirotake Sasaki, Kanagawa (JP); Masahiko Sekimoto, Kanagawa (JP); Toshinobu Hamazaki, Kanagawa (JP); Masato Matsuduki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/578,583

(22) Filed: Dec. 22, 2014

(65) Prior Publication Data

US 2015/0251450 A1 Sep. 10, 2015

(30) Foreign Application Priority Data

Mar. 5, 2014 (JP) ..... 2014-043243

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC .. B41J 11/002; B41J 11/0005; B41J 11/0015; B41M 7/0081; C09D 11/101; C09D 11/30
See application file for complete search history.

(56) References Cited

U.S. PATENT DOCUMENTS 6,283,590 B1 9/2001 Peter
6,390,618 B1 5/2002 Wotton et al.
8,556,407 B2 * 10/2013 Toya ..... B41J 11/002 347/102

FOREIGN PATENT DOCUMENTS

JP 2001-146009 5/2001
JP 2001-191507 7/2001
JP 2006-015591 1/2006

OTHER PUBLICATIONS

Abstract and machine translation of JP 2006-015591.

* cited by examiner

*Primary Examiner* — Thinh Nguyen
(74) *Attorney, Agent, or Firm* — Fildes & Outland, P.C.

(57) ABSTRACT

A drying device includes: a drying unit including: a heating space having a heating unit; a drying space that has a conveyance path of a recording medium and in which the recording medium is dried by radiation heat produced by the heating unit; and a partition member that separates the heating space and the drying space from each other in such a manner that gas can move between the heating space and the drying space; a first supply unit that supplies gas to the drying unit in a direction that is opposite to a conveying direction of the recording medium; and a second supply unit that supplies gas to the drying unit in a direction from the heating unit to the partition member.

18 Claims, 12 Drawing Sheets

DRYING DEVICE AND IMAGE FORMING APPARATUS

CROSS-REFERENCE TO RELATED APPLICATIONS

This application is based on and claims priority under 35 USC 119 from Japanese Patent Application No. 2014-043243 filed on Mar. 5, 2014.

BACKGROUND

Technical Field

The present invention relates to a drying device and an image forming apparatus.

SUMMARY

According to an aspect of the invention, there is provided a drying device comprising: a drying unit comprising: a heating space having a heating unit; a drying space that has a conveyance path of a recording medium and in which the recording medium is dried by radiation heat produced by the heating unit; and a partition member that separates the heating space and the drying space from each other in such a manner that gas can move between them; a first supply unit that supplies gas to the drying unit in a direction that is opposite to a conveying direction of the recording medium; and a second supply unit that supplies gas to the drying unit in a direction from the heating unit to the partition member.

DESCRIPTION OF SYMBOLS

Figure 1:
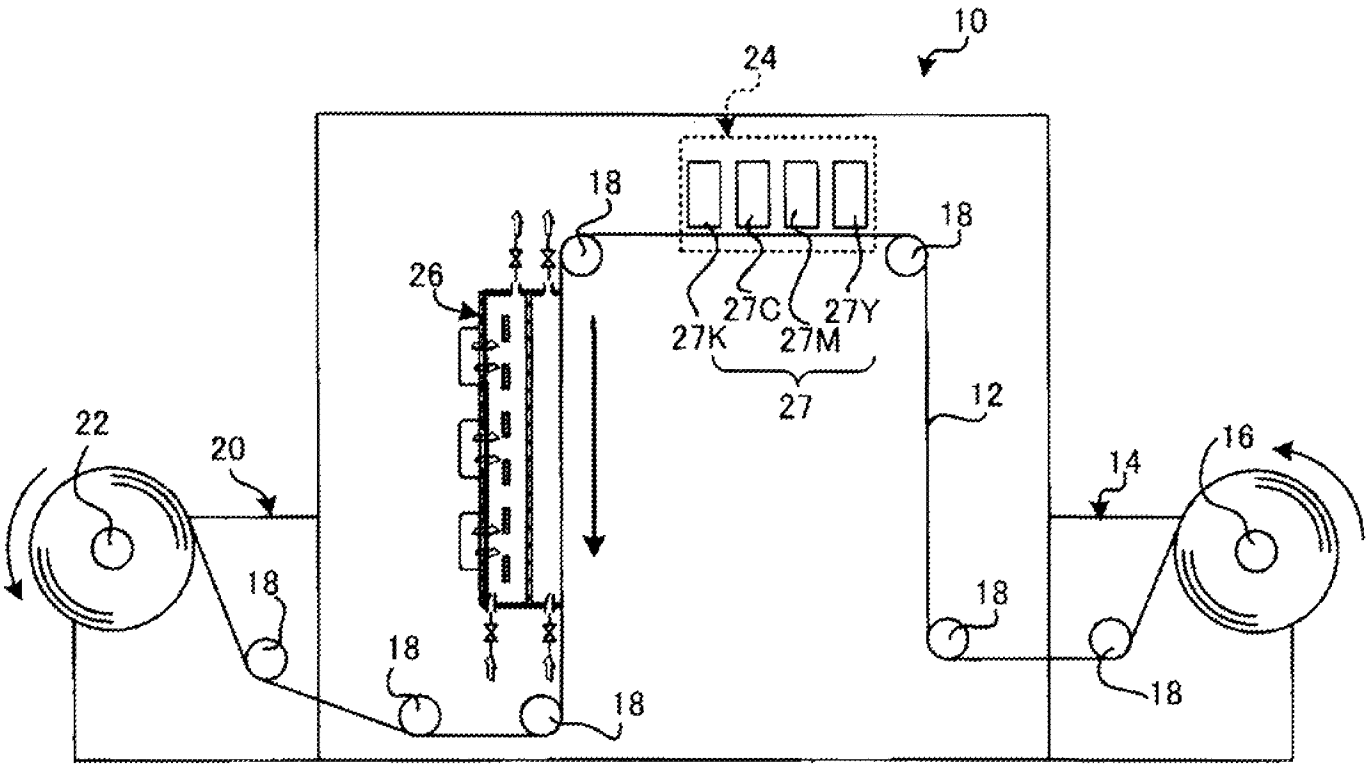
FIG. 1 shows a general configuration of an image recording apparatus according to an exemplary embodiment.

10: Image recording apparatus
12: Recording medium
14: Sheet supply unit
16: Sheet supply roller
18: Relay roller
20: Housing unit
22: Takeup roller
24: Image forming unit
26: Drying unit
27 (27Y, 27M, 27C, 27K): Inkjet head
28: Main frame body
28A: First wall
28B: Second wall
28C: Third wall
28D: Fourth wall
30: Heating space
32: Drying space
34, 36: Inlet
38: 40: Outlet
42: Wire gauze (partition member)
44: Heater unit
48: Backside fan unit
50: Base member
52: Blowing hole
54: Backside fan

DETAILED DESCRIPTION

FIG. 1 outlines an inkjet image recording apparatus 10 (hereinafter referred to simply as an image recording apparatus 10) which is an image forming apparatus according to the present invention. In the image recording apparatus 10 according to the exemplary embodiment, an image is recorded (printed) by ejecting inks onto a recording medium 12 by an inkjet method and is then dried.

As shown in FIG. 1, the recording medium 12 is loaded in a sheet supply unit 14 in advance in such a manner as to be wound around a sheet supply roller 16 in layers. Part of the recording medium 12 that has been paid out from the sheet supply roller 16 is wound on plural relay rollers 18 and wound around a takeup roller 22 of a housing unit 20. A motor (not shown) is attached to the takeup roller 22 rotates it in taking up part of the recording medium 12. That is, the takeup roller 22 is a drive roller and the other rollers are follower rollers.

Another mechanism is possible in which a motor is attached to the sheet supply roller 16 or the relay rollers 18 to make it or them a drive roller(s) and a paid-out part of the recording medium 12 is taken up while tension of a part of the recording medium 12 between each pair of adjoining rollers is adjusted. In this case, position sensors or tension sensors for detecting loosening of the recording medium 12 may be provided and the rotation speed (and the rotation direction) of the drive roller(s) may be controlled by a feedback control.

As shown in FIG. 1, a region where a part of the recording medium 12 is conveyed horizontally and straightly is provided between a pair of relay rollers 18 and an image forming unit 24 is disposed there. A region where a part of the recording medium 12 is conveyed vertically and straightly is provided between another pair of relay rollers 18 downstream of the image forming unit 24 and a drying unit 26 is disposed there.

Inkjet heads 27Y, 27M, 27C, and 27K of Y (yellow), M (magenta), C (cyan), and K (black) are arranged in the image forming unit 24 and may be referred to generically as an inkjet head(s) 27 below. Ink that is stored in an ink cassette, for example, is brought into each ink head 27 and ink droplets are ejected out of nozzles toward a part of the recording medium 12 opposed to the nozzles by a pressure control, an ultrasonic control, or the like.

In the image recording apparatus 10 according to the exemplary embodiment, the nozzles are arranged so as to cover the entire length of the recording medium 12 in the main scanning direction and the inkjet heads 27 of the respective colors are arranged in the auxiliary scanning direction of the recording medium 12. Ink droplets of amounts corresponding to image data are ejected out of the nozzles of each inkjet head 27 in synchronism with conveyance of the recording medium 12. The manners of arrangement of the nozzles and the inkjet heads 27 are not limited to the above ones; a configuration is possible in which each inkjet head 27 is moved in the main scanning direction.

In the drying unit 26, a part of the recording medium 12 on which an image has been formed by the image forming unit 24 is conveyed downward (as viewed in FIG. 1). As the recording medium 12 is conveyed, image-formed surface portions are sequentially placed in the drying region.

Figure 2:
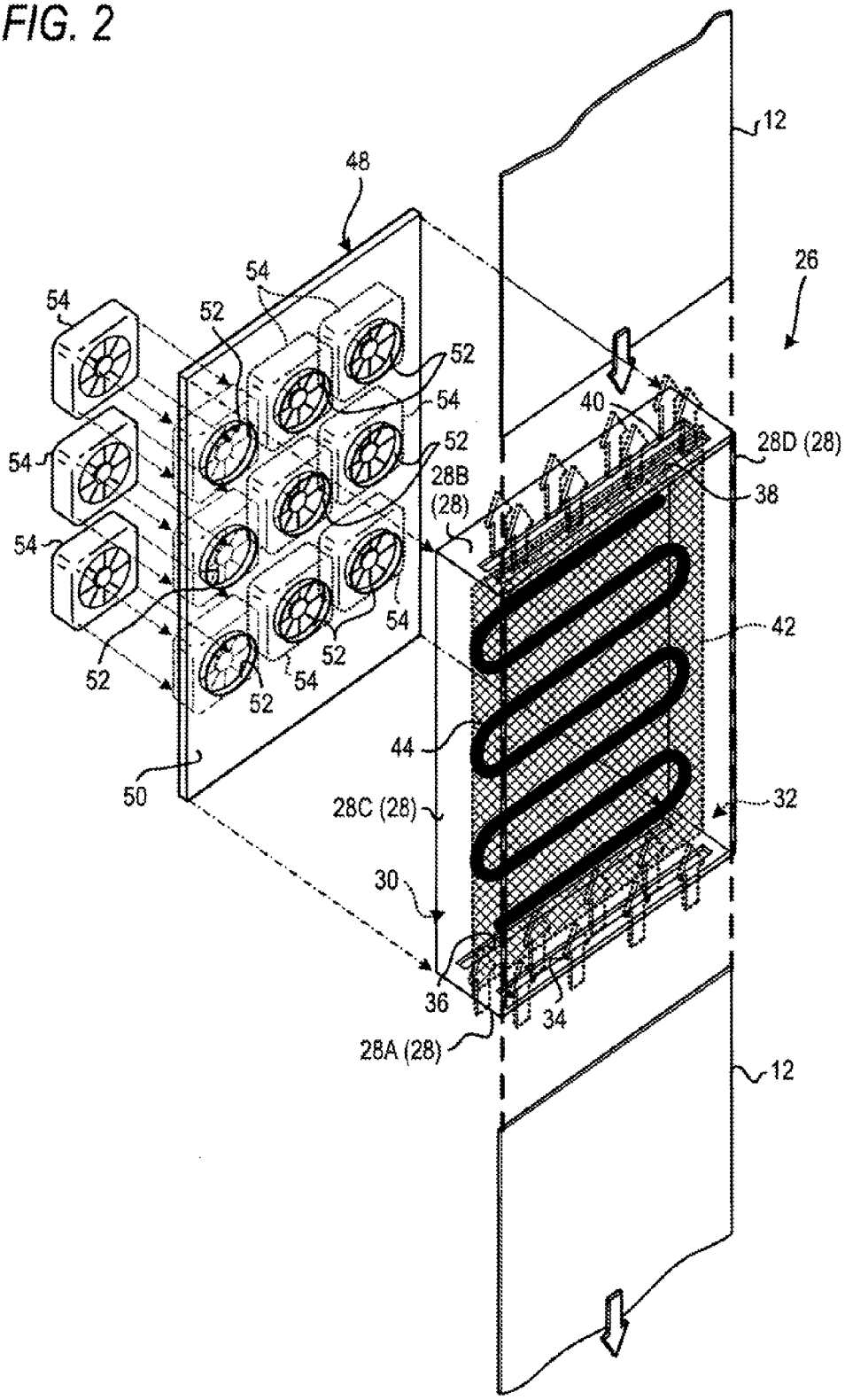
FIG. 2 is an exploded perspective view of a drying unit according to the exemplary embodiment.

FIG. 2 is an exploded perspective view of the drying unit 26. The drying unit 26 is equipped with a main frame body 28 having four walls. That is, having top and bottom (as viewed in FIG. 2) parallel plates and left and right parallel plates, the main frame body 28 assume a rectangular parallelepiped shape.

In the following description of the exemplary embodiment, the orientation of the drying unit 26 varies depending on the drawing. Therefore, in the following, the bottom plate, top plate, left plate, and right plate of the main frame body 28 as viewed in FIG. 2 will be referred to as a first wall 28A, second wall 28B, third wall 28C, and fourth wall 28D, respectively.

Two drying wind inlets 34 and 36 are formed through the first wall 28A so as to communicate with the inside space (drying space 32 and heating space 30 (described later)) of the main frame body 28. The drying wind inlets 34 and 36 extend in the longitudinal direction of the first wall 28A and shaped like slits. The drying wind inlets 34 and 36 are provided with ducts (not shown) through which to supply gas (air) independently. Therefore, gas can be supplied to the inside space through the inlets 34 and 36 at different flow speeds.

Two gas outlets 38 and 40 are formed through the second wall 28B so as to communicate with the inside space of the main frame body 28. The outlets 38 and 40 extend in the longitudinal direction of the second wall 28B and shaped like slits. The outlets 38 and 40 are provided with ducts (not shown) for gas discharge. The ducts are provided independently for the outlets 38 and 40 and a suction pump (not shown) is attached to them. However, in calculations, natural opening may be similar in performance to pump suction. Although the exemplary embodiment actually employs pump suction rather than natural opening, the term "natural opening" includes a case that natural opening is employed in a calculation. The outlets 38 and 40 can be opened or closed selectively.

A net member (in the exemplary embodiment, a wire gauze 42) which is a partition member is disposed in the main frame body 28 so as to partition its inside space. The dimensions of the wire gauze 42 correspond to the inner dimensions of the main frame body 28, and its circumferential edges are fixed to the inner surfaces of the main frame body 28 (i.e., the inner surfaces of the first to fourth walls 28A-28D). No limitations are imposed on the method for fixing the wire gauze 42; it may be any of various fixing methods such as fitting into grooves formed in the inner surfaces of the main frame body 28, fixing via brackets, and fixing with adhesive.

The wire gauze 42 is required to be heat-resistant and it is preferable that it be made of a metal such as aluminum, stainless steel, iron, or gold. Although no limitations are imposed of the metal material, to prevent overheating of a sheet not being conveyed, metals that produce less radiation heat are preferable. The partition member may be a metal plate through which holes are formed, in place of the wire gauze 42.

The wire gauze 42 serves to divide the inside space (i.e., the space between the confronting openings) of the main frame body 28. The deep-side one (see FIG. 2) of the divisional spaces of the inside space is the heating space 30 in which a heater unit 44 is disposed. Having a rod-shaped heating body, the heater unit 44 generates heat by converting electric energy into thermal energy. Since the heater unit 44 is intended to accelerate evaporation and drying of inks by causing them to absorb thermal energy (radiation heat) produced by the heater unit 44, it is preferable that the radiation energy spectrum of the heating body overlap with the energy absorption spectrum of water. Although an infrared heat is a typical example, the heater unit 44 is not limited to it.

On the other hand, the view's-side divisional space (see FIG. 2) is the drying space 32 in which a part of the recording medium 12 is conveyed parallel with the opening.

Figure 3A:
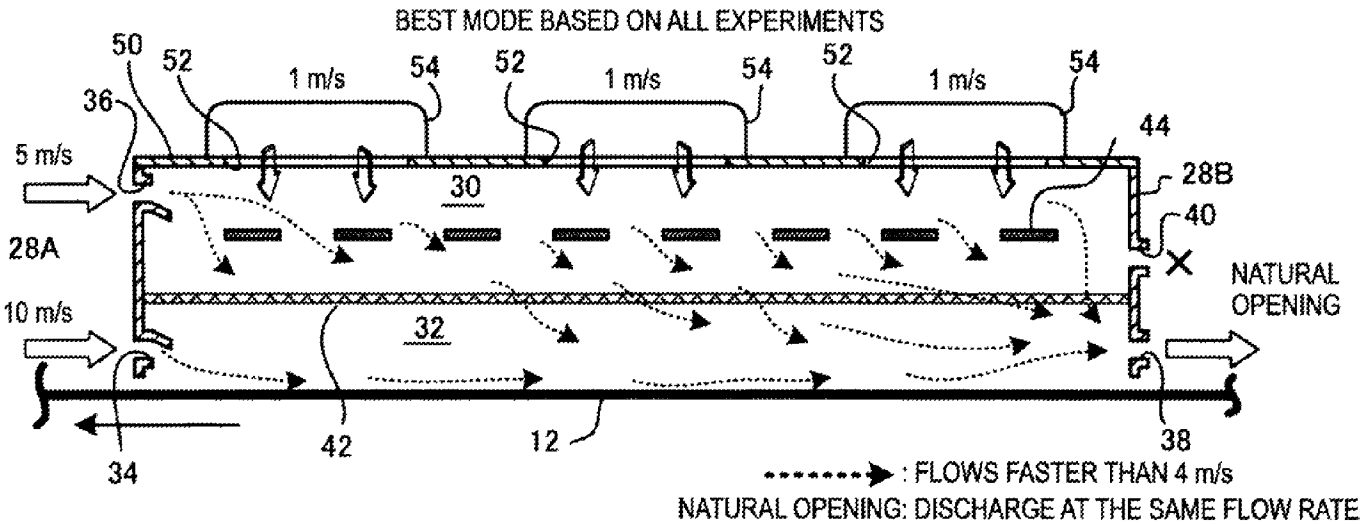
FIG. 3A is a (rotated) vertical sectional view of the drying unit in which opening/closure of inlets and blowing holes and flow rates of drying winds are set in preferable manners.
Figure 3B:
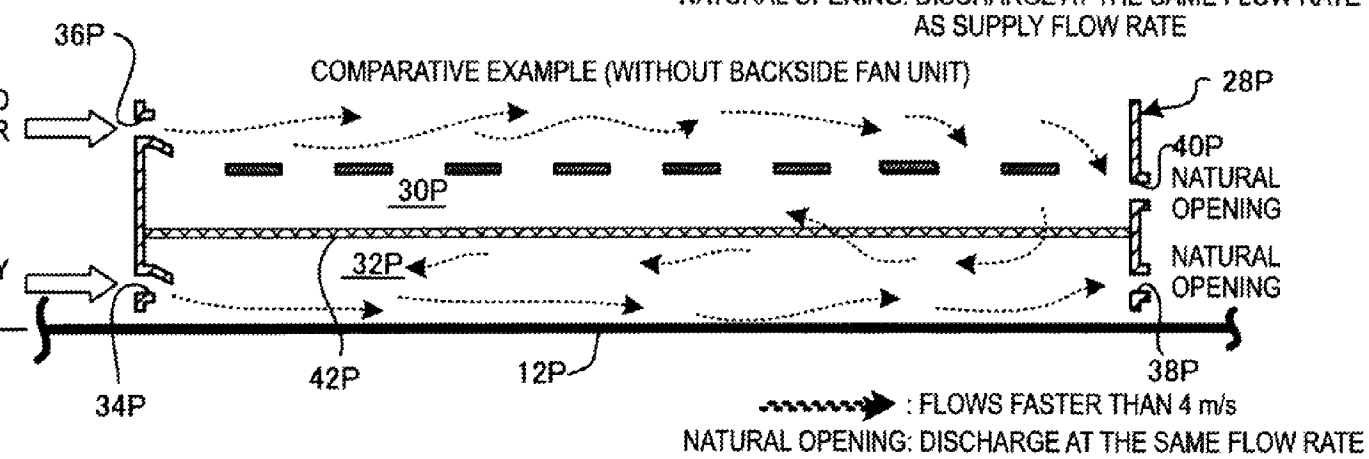
FIG. 3B is a vertical sectional view of a drying unit of Comparative Example.

FIG. 3A shows the drying unit 26 in such a manner that it is rotated clockwise by 90° from the state of FIG. 1. FIG. 3B shows a drying unit of Comparative Example (described later) for comparison with the drying unit 26.

As shown in FIG. 3A, the inlets 34 and 36 are formed so as to be associated with the drying space 32 and the heating space 30, respectively, which are separated from each other by the wire gauze 42. The outlets 38 and 40 are formed so as to be associated with the drying space 32 and the heating space 30, respectively. That is, the single inlet 34 and the single outlet 38 are provided for the drying space 32 and the single inlet 36 and the single outlet 40 are provided for the heating space 30.

Because of the structure of the wire gauze 42, objects that are larger than the holes of the wire gauze 42 cannot move between the heating space 30 and the drying space 32 but gas can move between them. In other words, whereas gas can flow from the heating space 30 to the drying space 32, no part of the recording medium 12 can move from the drying space 32 to the heating space 30.

Figure 4A:
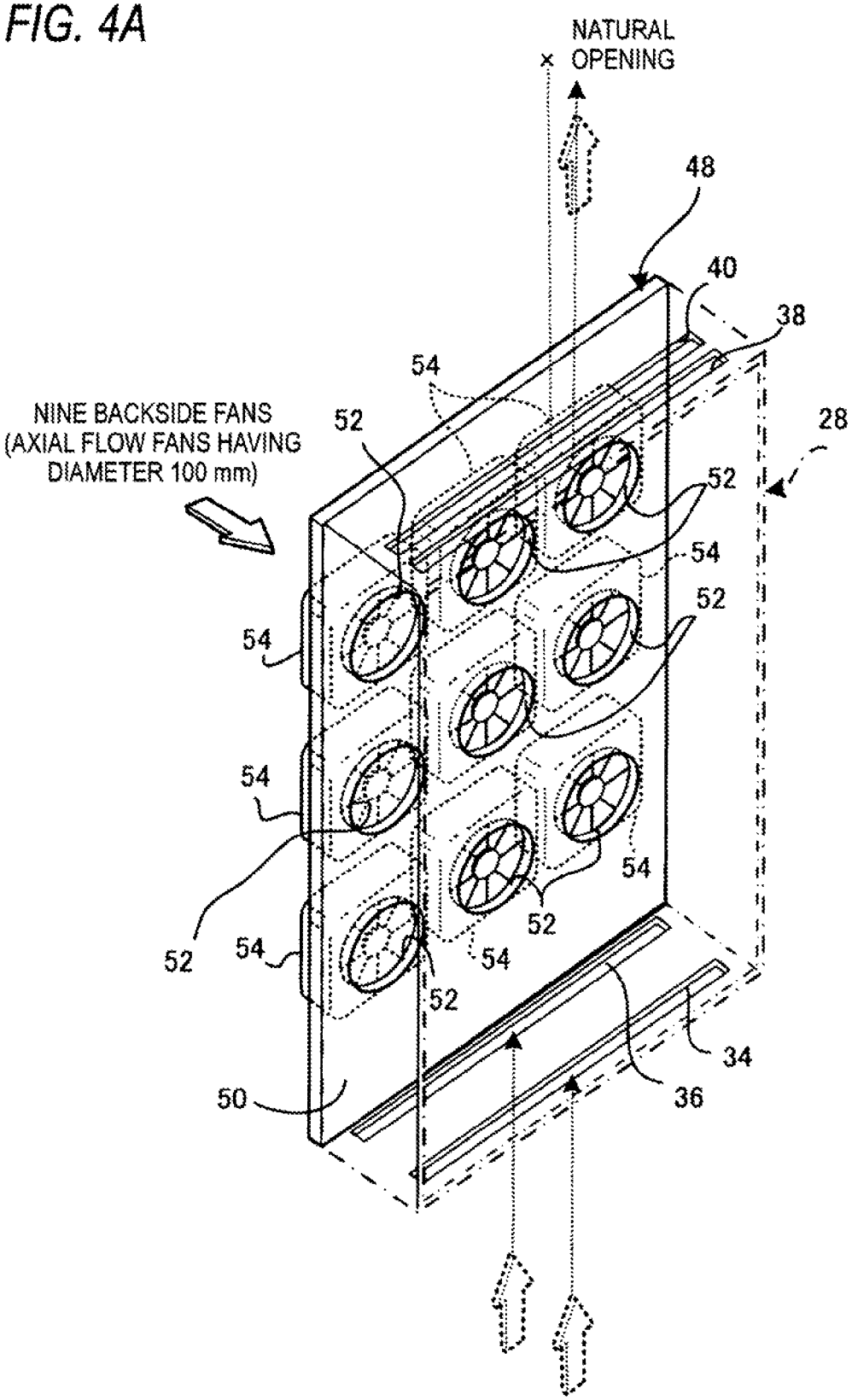
FIG. 4A is a perspective view of a backside fan unit which is provided in the drying unit.

As shown in FIG. 4A, a backside fan unit 48 is equipped with a base member 50 which closes the heating-space-30-side opening of the main frame body 28. Nine circular holes are formed through the base member 50 as gas blowing holes 52. It is preferable that the gas blowing holes 52 be formed in such a manner that their centers coincide with the centers of nine rectangular divisional regions obtained by equally dividing the base member 50. The nine blowing holes 52 may be arranged in a staggered or irregular form.

Nine backside fans 54 which are axial flow fans are attached to the base member 50. Each backside fan 54 has a structure that blades are attached to a rotary shaft and rotated by driving the rotary shaft by a motor. In the exemplary embodiment, the blade diameter is equal to 100 mm. Each backside fan 54 is attached to the base member 50 in such a manner that its rotary shaft coincides with the center of the blowing hole 52 (circular hole). The nine blowing holes 52 serve as blowing holes for drying winds when the backside fans 54 are driven.

As shown in FIG. 3A, gas that is supplied from the backside fans 54 flows mainly in such a manner as to be heated as it passes the heater unit 44 (heating body) from its back side to the front side in the heating space 30 and to then reach the wire gauze 42.

The backside fans 54 are not limited to axial flow fans, and the number of backside fans 54 need not always be equal to nine. Gas flows may be produced at another place and guided to the base member 50 by ducts. each gas blowing hole 52 need not always be circular and may have any of other shapes such as a slit and meshes.

In the exemplary embodiment, a first object of using gas that flows inside the drying unit 26 is to cool, that is, prevent overheating of, the inside of the drying unit 26 (described later in detail). A second object is to remove humid gas from around a target part of the recording medium 12 to assist drying of that part of the recording medium 12 by radiation heat of the heater unit 44. Therefore, in the following, the gas flow will be referred to as a "drying wind."

The drying unit 26 has, as inlets for drying winds, the inlets 34 and 36 which are formed through the first wall 28A and blowing holes 52 which are formed in the backside fan unit 48. On the other hand, the drying unit 26 has, as outlets for drying winds, the outlets 38 and 40 which are formed through the second wall 28B.

In the drying unit 26 according to the exemplary embodiment, drying winds that are supplied through the inlets 34 and 36 and the blowing holes 52 are blown over an image-formed surface portion of the recording medium 12 being conveyed. As a result, gas containing water vapor that has been evaporated from this part of the recording medium 12 by drying by radiation heat is removed from it.

Main streams of drying winds are formed by drying winds that are supplied through the inlets 34 and 36 and flow parallel with an image-formed surface portion of the recording medium 12 in the direction opposite to the conveying direction of the recording medium 12, and humid gas produced by drying is discharged through the outlets 38 and 40. Since drying winds flow in the direction opposite to the conveying direction of the recording medium 12, their relative flow speeds are increased and hence their ability to remove humid gas is enhanced.

In the drying unit 26 according to the exemplary embodiment in which the heating space 30 and the drying space 32 are separated from each other by the wire gauze 42 is higher in drying efficiency than a radiation heating type drying device in which the heating space 30 and the drying space 32 are separated by a glass plate or a metal plate because thermal energy generated by the heater unit 44 can be used without being wasted partially. In addition, drying winds increase the ability to remove humid gas per unit time.

On the other hand, the fact that drying winds can move between the heating space 30 and the drying space 32 means that paper powder produced from the recording medium 12 in the drying space 32 may go into the heating space 30 while drying is performed. In the exemplary embodiment, this problem is solved by attaching the backside fan unit 48. That is, the backside fan unit 48 sends necessary drying winds from behind the heater unit 44 through the blowing holes 52, and thereby stops air flows that would otherwise move from the drying space 32 through the wire gauze 42 and prevents paper powder from reaching the heating space 30.

Drying winds (air flows) produced by the backside fan unit 48 flow to reach the heater unit 44, the wire gauze 42, and the recording medium 12 in this order. Therefore, in an emergency such as a stop of conveyance of the recording medium 12, drying winds exercise their cooling function, that is, cool the heater unit 44 and the wire gauze 42 and prevent overdrying of a target part of the recording medium 12 due to overheating.

Figure 4B:
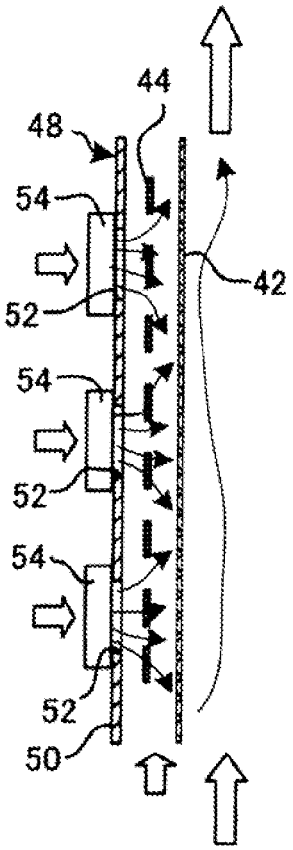
FIG. 4B shows stream line of drying winds produced by the backside fan unit.

FIG. 4B shows, by arrows, stream line of drying winds produced by the backside fan unit 48. In the heating space 30, drying winds sent through the blowing holes 52 are blown over the heater unit 44 uniformly. As a result, in the drying space 32, a drying wind sent from the inlet 34 reaches the outlet 38 after going in the direction opposite to the conveying direction of the recording medium 12 without being directed to the heating space 30.

Figure 4C:
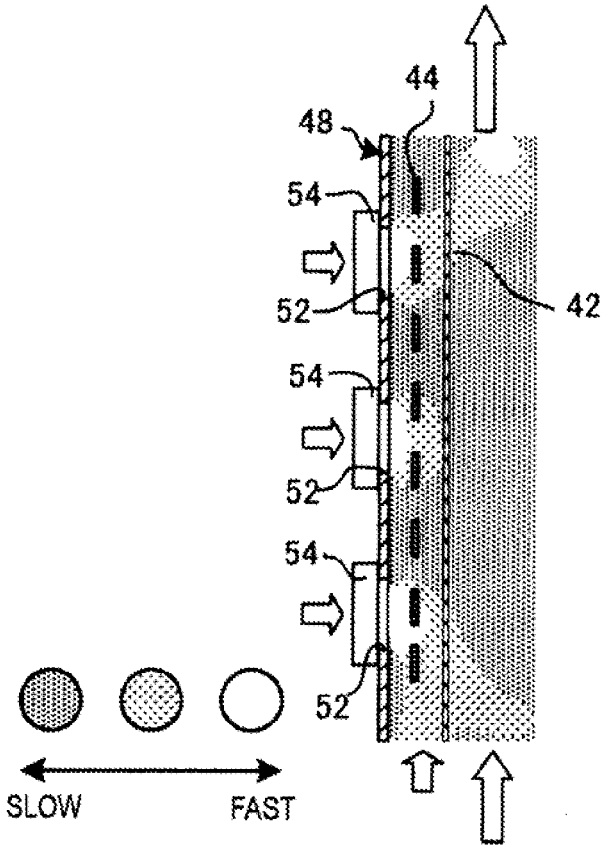
FIG. 4C is a chart showing a drying wind flow speed distribution characteristic of the backside fan unit.

FIG. 4C is a chart showing a flow speed distribution characteristic of the backside fan unit 48. It is seen that there is no speed variations that would cause circulating flows.

Workings of the drying unit 26 according to the exemplary embodiment will be described below.

FIG. 3A shows a preferable mode in which the opening/closing states of the inlets 34 and 36, the blowing holes 52, and the outlets 38 and 40 and the flow speeds of drying winds supplied through the inlets 34 and 36 and the blowing holes 52 are ones obtained by experiments (described later), in the drying unit 26 according to the exemplary embodiment. Since the opening areas of the inlets 34 and 36 and the blowing holes 52 are fixed, flow rates are determined necessarily once flow speeds are set.

FIG. 3A shows the drying unit 26 according to the exemplary embodiment being in the preferable mode, conditions of which are set as follows:

(Condition 1) The flow speed of a drying wind supplied through the drying-space-32-side inlet 34 is 10 m/s.

(Condition 2) The flow speed of a drying wind supplied through the heating-space-30-side inlet 36 is 5 m/s.

(Condition 3) The flow speed of drying winds supplied through the blowing holes 52 of the backside fan unit 48 is 1 m/s.

(Condition 4) The drying-space-32-side outlet 38 is in a natural opening state in terms of calculation.

(Condition 5) The heating-space-30-side outlet 40 is closed.

FIG. 3B shows a drying unit of Comparative Example which is equipped with no backside fan unit. The drying unit of Comparative Example is the same as the drying unit 26 according to the exemplary embodiment except that no backside fan unit is provided. Therefore, descriptions of the drying unit of Comparative Example are omitted with the use of symbols that are obtained by attaching suffix "P" to the corresponding symbols of the drying unit 26.

In the drying unit 26P of Comparative Example, the flow speed of a drying wind supplied through the drying-space-32P-side inlet 34P is 10 to 20 m/s. The heating-space-30-side inlet 34 is open to the ambient air. The two outlets 38P and 40P are in a natural opening state in terms of calculation.

In FIGS. 3A and 3B, drying wind flows that are faster than 4 m/s are indicated by arrows. Whereas clear reverse flows (circulating flows) are found in FIG. 3B, no circulating flows are found in FIG. 3A.

Table 1 shows evaluation results, that is, results of comparison between the preferable mode according to the exemplary embodiment shown in FIG. 3A and Comparative Example shown in FIG. 3B.

TABLE 1

| | Backside fan unit | Circulating flows | Heater cooling effect | Wire gauze cooling effect | Humid air removing effect |
|---|---|---|---|---|---|
| Preferable mode | Attached | Occur | High | High | High |
| Comparative Example | Not attached | Do not occur | Low | Low | Low |

As seen from Table 1, in the preferable mode in which the backside fan unit 48 is provided, no circulating flows occur and drying winds do not flow from the drying space 32 to the heating space 30. Therefore, paper powder produced from the recording medium 12 in the drying space 32 is prevented from going into the heating space 30 being carried by drying winds.

Since the backside fan unit 48 produce downward flows (as viewed in FIG. 3A) of drying winds, the flow speeds of drying winds at the wire gauze 42 are higher and hence the effect of cooling the wire gauze 42 is higher than in the case without the backside fan unit 48. Furthermore, because no circulating flows occur, humid air containing water evaporated from a target part of the recording medium 12 is discharged efficiently through the outlet 38.

When the recording medium 12 undergoes an emergency stop, there may occur an event that stagnant drying winds are heated gradually even if the heater unit 44 is turned off, resulting in overheating of a target part of the recording medium 12. In the exemplary embodiment, such overheating of a target part of the recording medium 12 is prevented because drying winds produced by the backside fans 54 cool the heater unit 44 and the wire gauze 42.

(Experiments)

FIGS. 5A-5C to FIGS. 7A-7C show Experiments 1-3 for finding preferable parameter values of the preferable mode of the drying unit 26 (see FIG. 3A).

(Experiment 1)

Experiment 1 is to check gas flow characteristics in the drying unit 26 for three patterns of combinations of conditions on the drying wind supply side and discharge side. Whether or not paper power goes into the heating space 30 is judged on the basis of presence/absence of drying winds flowing toward the heating space 30. "Natural opening" is a term of calculation.

TABLE 2

| Pattern | Drying-space-side inlet | Heating-space-side inlet | Blowing holes of backside fans | Drying-space-side outlet | Heating-space-side outlet |
|---|---|---|---|---|---|
| 1 | 10 m/s | Closed | 1 m/s | Natural opening | Natural opening |
| 2 | 10 m/s | Closed | 1 m/s | Natural opening | Closed |
| 3 | 10 m/s | 5 m/s | 1 m/s | Natural opening | Natural opening |

In Experiment 1, the degree of stagnation of drying winds decreases in order of Pattern 1, Pattern 2, and Pattern 3. One cause of circulating flows is stagnation of drying winds.

Figure 5A:
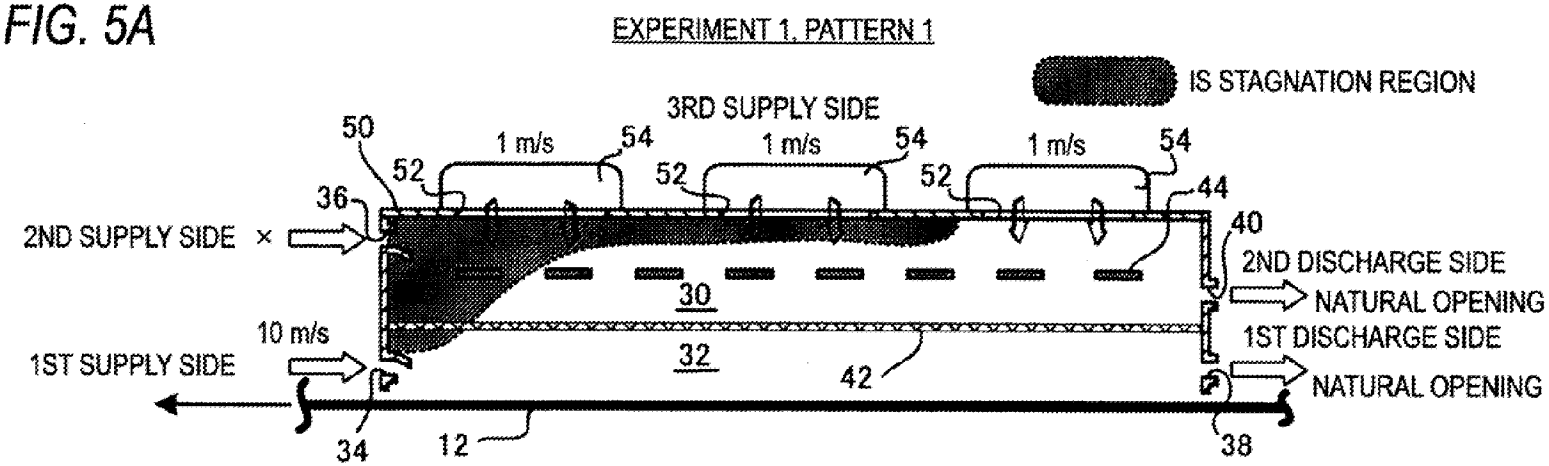
FIGS. 5A, 5B and 5C are (rotated) vertical sectional views of the drying unit in Patterns 1, 2 and 3 of Experiment 1, respectively.

As seen from FIG. 5A, in Pattern 1, no drying wind is supplied through the heating-space-30-side inlet 36 and the heating-space-30 outlet 40 is in a natural opening state in terms of calculation. It is seen that in Pattern 1 stagnation occurs most remarkably though the backside fan unit 48 is provided.

Figure 5B:
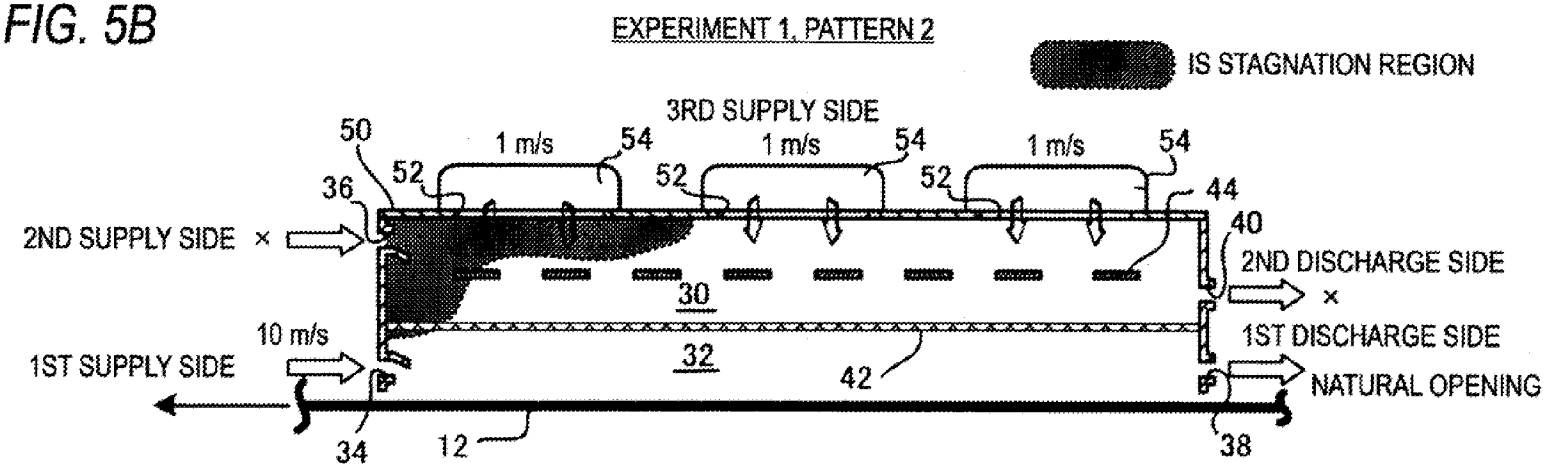

As shown in FIG. 5B, Pattern 2 is different from Pattern 1 in that the heating-space-30 outlet 40 is closed. Although Pattern 2 is improved from Pattern 1, stagnation of drying winds still occurs.

Figure 5C:
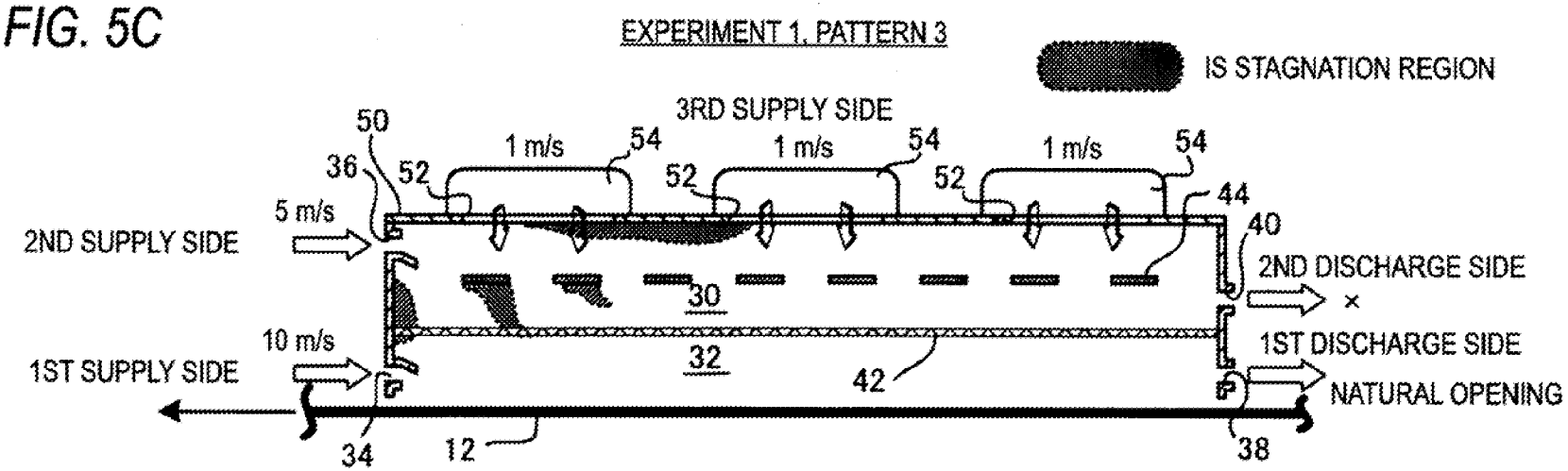

On the other hand, as shown in FIG. 5C, Pattern 3 is different from Pattern 1 in that a drying wind is supplied through the heating-space-30-side inlet 36 at 5 m/s. In Pattern 3, the function of the backside fan unit 48 is utilized sufficiently and the degree of stagnation of drying winds is very low.

Evaluation Results of Experiment 1:

In Experiment 1, the degree of stagnation of drying winds (gas) which occurs mainly in the heating space 30 varies depending on the number of inlets and outlets used. It is preferable that drying wind supply be made to both of the heating space 30 and the drying space 32 and drying wind discharge be made only from the drying space 32.

When a drying wind is supplied through the heating-space-30-side inlet 36, the function of the backside fan unit 48 is utilized sufficiently, as a result of which no circulating flows occur and paper powder is prevented from going into the heating space 30.

It is concluded that the most preferable mode of Experiment 1 is Pattern 3.

(Experiment 2)

Experiment 2 is to check drying wind (gas) flow characteristics in the drying unit 26 (heating space 30 and drying space 32) for three patterns in which the flow speed at the heating-space-30-side (second supply side) inlet 36 is different. A temperature variation of the wire gauze 42 and whether or not paper power produced in the drying space 32 goes into the heating space 30 are judged. "Natural opening" is a term of calculation.

TABLE 3

| Pattern | Drying-space-side inlet | Heating-space-side inlet | Blowing holes of backside fans | Drying-space-side outlet | Heating-space-side outlet |
|---|---|---|---|---|---|
| 1 | 10 m/s | 2 m/s | 1 m/s | Natural opening | Closed |
| 2 | 10 m/s | 5 m/s | 1 m/s | Natural opening | Closed |
| 3 | 10 m/s | 8 m/s | 1 m/s | Natural opening | Closed |

Figure 6A:
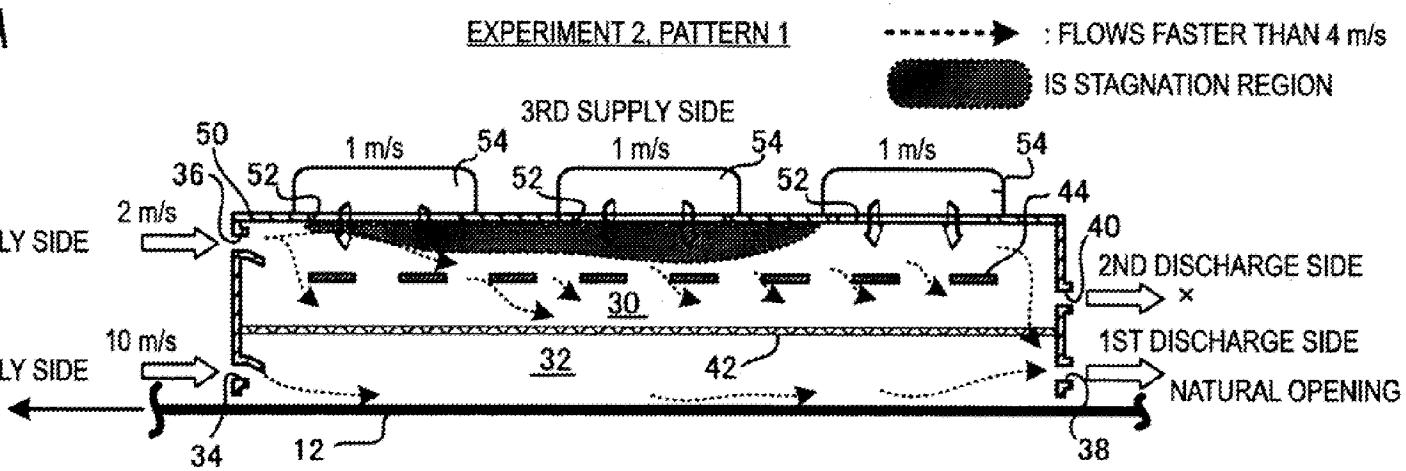
FIGS. 6A, 6B and 6C are (rotated) vertical sectional views of the drying unit in Patterns 1-3 of Experiment 2, respectively.

As shown in FIG. 6A, in Pattern 1 of Experiment 2, whereas the temperature of the wire gauze 42 tends to be higher than a desired temperature, no circulating flows occur.

Figure 6B:
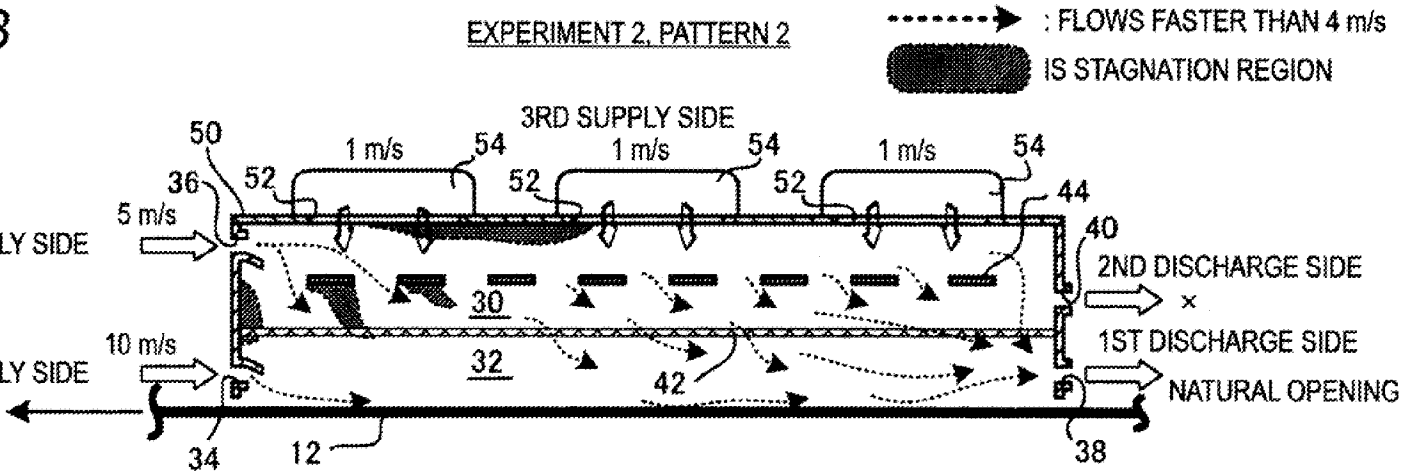

As shown in FIG. 6B, in Pattern 2, the temperature of the wire gauze 42 is lower than the desired temperature and no circulating flows occur.

Figure 6C:
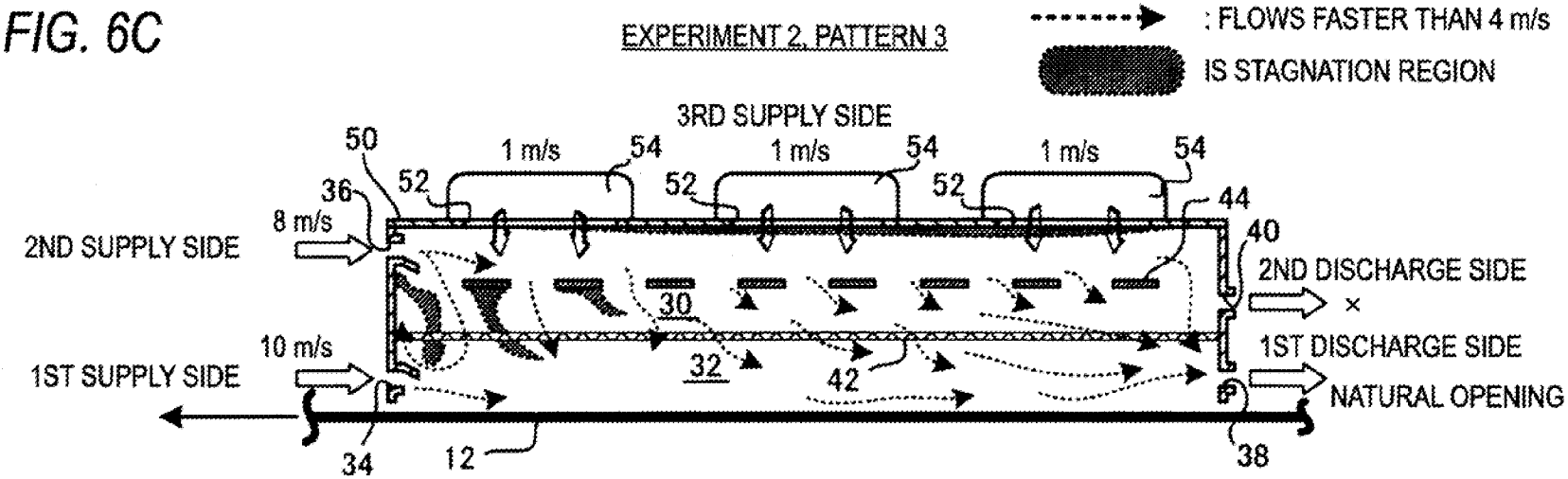
Figure 7A:
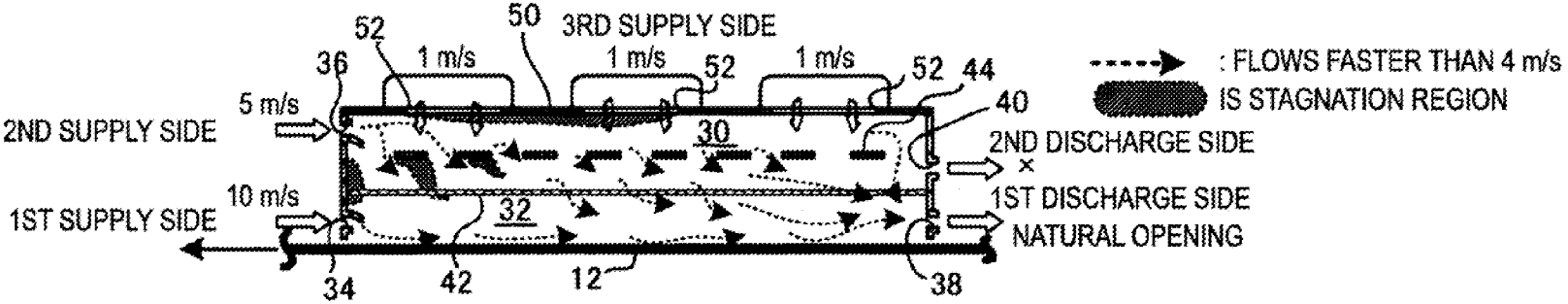
FIGS. 7A, 7B, 7C and 7D are (rotated) vertical sectional views of the drying unit in Patterns 1, 2, 3 and 4 of Experiment 3, respectively.
Figure 7B:
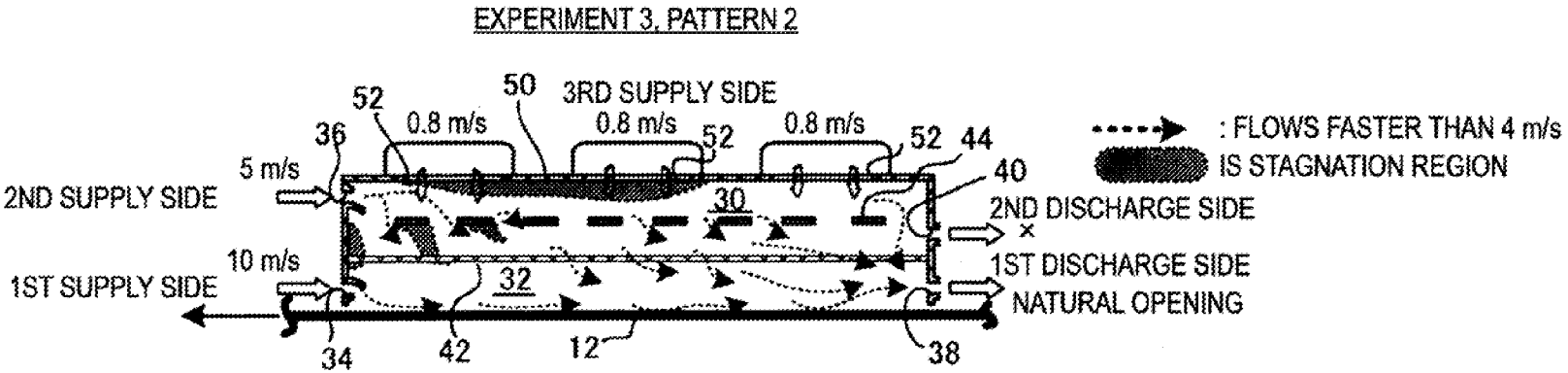
Figure 7C:
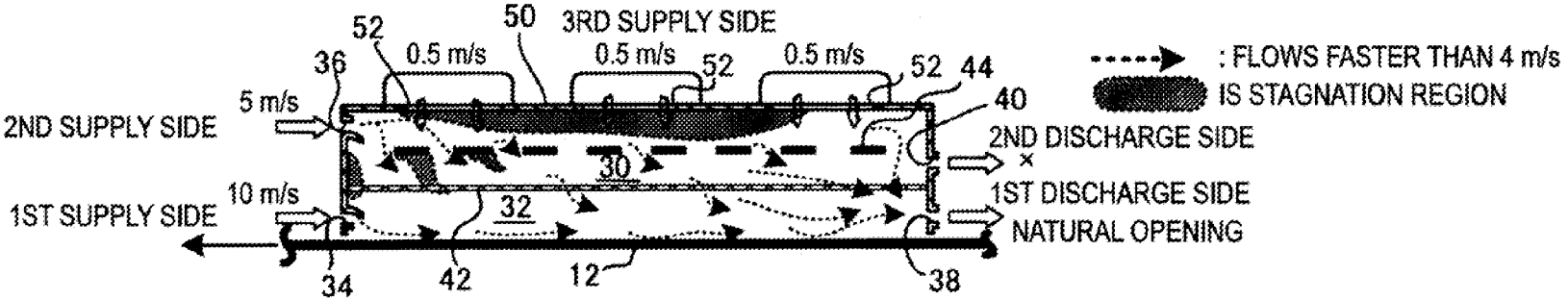
Figure 7D:
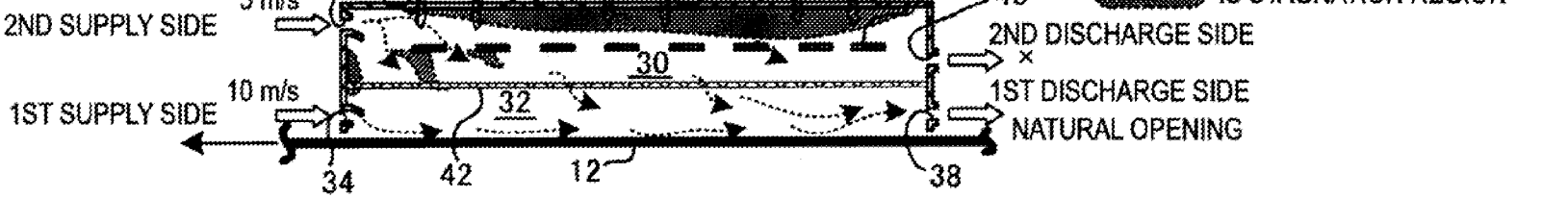

As shown in FIG. 6C, in Pattern 3, although the temperature of the wire gauze 42 is lower than the desired temperature, circulating flows occur and hence paper powder may go into the heating space 30.

Evaluation Results of Experiment 2:

Experiment 2 shows that the temperature of the wire gauze 42 can more likely be made lower than the desired temperature as the flow speed at the heating-space-30-side inlet 36 increases, and that circulating flows occur (due to shear flows) near the inlets 34 and 36 if the flow speed is too high. It is seen that the flow speed at the heating-space-30-side inlet 36 has an allowable upper limit and lower limit. It is concluded that the most preferable mode of Experiment 2 is Pattern 2.

(Experiment 3)

Experiment 3 is to check drying wind (gas) flow characteristics in the drying unit 26 (heating space 30 and drying space 32) for four patterns in which the flow speed in the backside fan unit 48 is different. A temperature variation of the wire gauze 42 and whether or not paper power produced in the drying space 32 goes into the heating space 30 are judged. "Natural opening" is a term of calculation.

TABLE 4

| Pattern | Drying-space-side inlet | Heating-space-side inlet | Blowing holes of backside fans | Drying-space-side outlet | Heating-space-side outlet |
|---|---|---|---|---|---|
| 1 | 10 m/s | 5 m/s | 1 m/s | Natural opening | Closed |
| 2 | 10 m/s | 5 m/s | 0.8 m/s | Natural opening | Closed |
| 3 | 10 m/s | 5 m/s | 0.5 m/s | Natural opening | Closed |
| 4 | 10 m/s | 5 m/s | 0.3 m/s | Natural opening | Closed |

As shown in FIGS. 7A-7D, in Patterns 1-4 of Experiment 3, the flow speed of drying winds that are blown out of the blowing holes 52 of the backside fans 54 is 1 m/s, 0.8, m/s, 0.5 m/s, and 0.3 m/s, respectively.

In each of Patterns 1-4, the temperature of the wire gauze 42 is lower than the prescribed temperature and no circulating flows occur that causes paper powder to go into the heating space 30.

Evaluation Results of Experiment 3:

The flow speed of the backside fans 54 is not a major factor in causing circulating flows. The efficiency of cooling of the heater unit 44 and the wire gauze 42 (including suppression of circulating flows) increases as the flow speed of the backside fans 54 becomes higher. Since the cooling efficiency increases at a lower rate as it comes closer to the upper limit (100%), it is not necessary to be set to an unnecessarily a large value. The cooling efficiency does not vary much in a flow speed range that is higher than 1 m/s. Therefore, the most preferable mode of Experiment 3 is Pattern 1.

(Summary of Results of Experiments 1-3)

The flow speeds of drying winds of the drying unit 26 according to the exemplary embodiment shown in FIG. 3A are ones determined as a combination of the appropriate values of the preferable modes of Experiments 1-3.

That is, in the drying unit 26 according to the exemplary embodiment, the flow speeds of a drying wind supplied through the drying-space-32-side inlet 34, a drying wind supplied through the heating-space-30-side inlet 36, and drying winds supplied through the backside fans 54 are set to 10 m/s, 5 m/s, and 1 m/s, respectively. The heating-space-30 outlet 40 is closed and drying winds are discharged through the drying-space-32-side outlet 38 (natural opening in terms of calculation). As a result, as shown in Table 1, paper powder is prevented from going into the heating space 30 unlike in Comparative Example. And the effect of cooling the heater unit 44 (heating body) and the wire gauze 42 and the effect of removing humid air (i.e., drying efficiency) are made higher than in Comparative Example.

Although Experiments 1-3 are experiments carried out in such a manner that the conditions other than the one to be checked are set to fixed values, experiments may be done using plural conditions as variables.

(Drying of Narrow Recording Medium 12S)

In the exemplary embodiment, circulating flows which may cause paper powder to go into the heating space 30 are suppressed with the assumption that the drying-space-32-side opening is fully closed by a target part of the recording medium 12. However, in the case of a recording medium 12S which is narrower than the drying unit 26, a target part of it may be dried in a state that the drying-space-32-side opening is not fully closed.

Figure 8A:
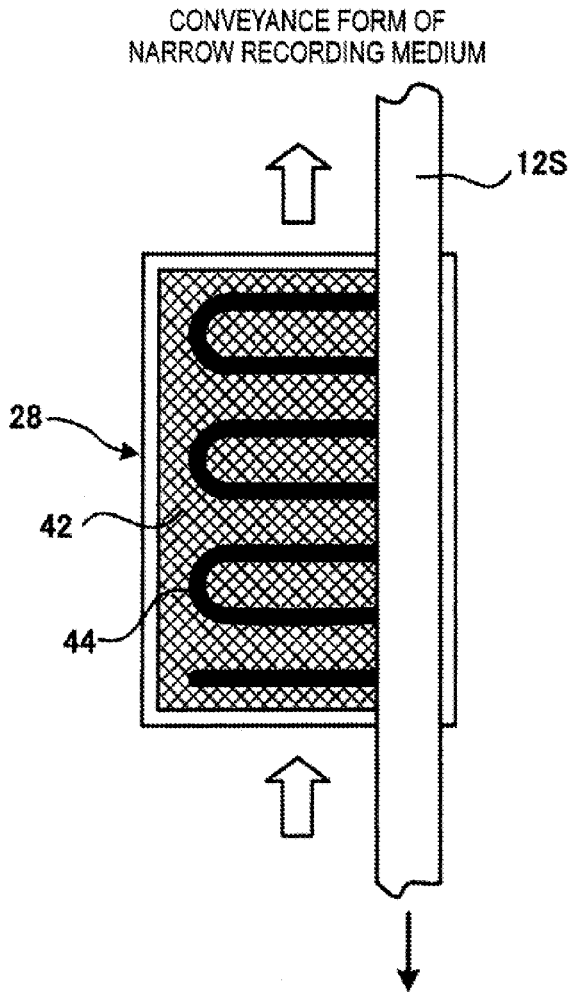
FIG. 8A is a front view of the drying unit in a case that a narrow recording medium is conveyed.

FIG. 8A is a front view (i.e., a view as viewed from the side of the drying space 32) of the drying unit 26. The wire gauze 42 and the heater unit 44 (heating body) are exposed except in the region where a target part of the recording medium 12S passes.

Figure 8B:
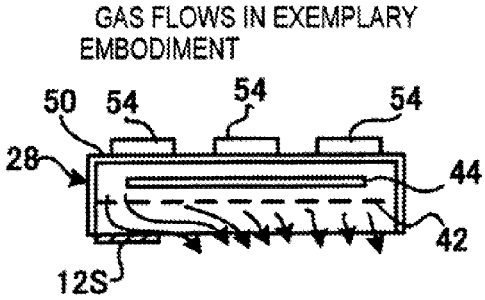
FIG. 8B is a horizontal sectional view of the drying unit according to the exemplary embodiment which is equipped with the backside fans and shows stream line in a case that a narrow recording medium is conveyed.
Figure 8C:
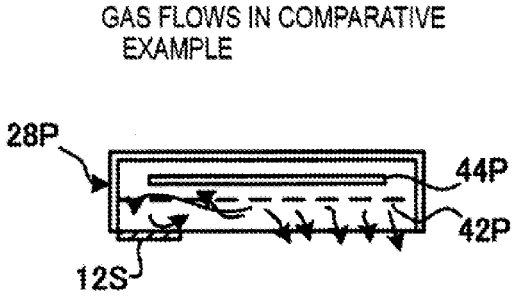
FIG. 8C is a horizontal sectional view of the drying unit of Comparative Example which is equipped with the backside fans and shows stream line in a case that a narrow recording medium is conveyed.

FIG. 8B shows, by arrows, how drying winds (gas) flow in the case where the backside fans 54 are attached (exemplary embodiment). FIG. 8C shows, by arrows, how drying winds (gas) flow in the case where the backside fan unit 48 (backside fans 54) is not attached (Comparative Example).

As seen from FIG. 8C, in Comparative Example, circulating flows occur over a target portion of the recording medium 12S and hence paper powder may go into the heating space 30. On the other hand, in the exemplary embodiment, as shown in FIG. 8B, occurrence of circulating flows is prevented even over a target portion of the recording medium 12S and hence entrance of powder into the heating space 30 is prevented.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A drying device comprising:

a drying unit comprising:

a heating space having a heating unit;

a drying space that has a conveyance path of a recording medium and in which the recording medium is dried by radiation heat produced by the heating unit; and a partition member that separates the heating space and the drying space from each other in such a manner that gas can move between the heating space and the drying space;

a first supply unit that supplies gas to the drying unit in a direction that is opposite to a conveying direction of the recording medium; and a second supply unit that supplies gas to the drying unit in a direction from the heating unit to the partition member.

2. The drying device according to claim 1, wherein the partition member prevents the recording medium from coming into contact with a heating source of the heating unit and has holes that enable sending of gas from the heating space to the drying space.

3. The drying device according to claim 2, wherein the heating space and the drying space are provided with respective inlets through which the first supply unit supplies gas to the drying unit, and a flow speed at the drying-space-side inlet is set higher than a flow speed at the heating-space-side inlet.

4. The drying device according to claim 3, further comprising a discharge unit that discharges the gas supplied by the first supply unit and the second supply unit.

5. The drying device according to claim 4, wherein:

the heating space and the drying space are provided with respective discharge units; and gas flow states in the drying unit are controlling by setting flow rates and flow speeds of the gas supplied by the first supply unit and the second supply unit and opening/closure of inlets of the first supply unit and the second supply unit and outlets of the respective discharge units.

6. The drying device according to claim 3, wherein when conveyance of the recording medium in the drying unit is stopped, the gas that is supplied by the second supply unit serves for cooling of the heating unit and the partition member.

7. The drying device according to claim 2, further comprising a discharge unit that discharges the gas supplied by the first supply unit and the second supply unit.

8. The drying device according to claim 7, wherein:

the heating space and the drying space are provided with respective discharge units; and gas flow states in the drying unit are controlling by setting flow rates and flow speeds of the gas supplied by the first supply unit and the second supply unit and opening/closure of inlets of the first supply unit and the second supply unit and outlets of the respective discharge units.

9. The drying device according to claim 2, wherein when conveyance of the recording medium in the drying unit is stopped, the gas that is supplied by the second supply unit serves for cooling of the heating unit and the partition member.

10. The drying device according to claim 1, wherein the heating space and the drying space are provided with respective inlets through which the first supply unit supplies gas to the drying unit, and a flow speed at the drying-space-side inlet is set higher than a flow speed at the heating-space-side inlet.

11. The drying device according to claim 10, further comprising a discharge unit that discharges the gas supplied by the first supply unit and the second supply unit.

12. The drying device according to claim 11, wherein:

the heating space and the drying space are provided with respective discharge units; and gas flow states in the drying unit are controlling by setting flow rates and flow speeds of the gas supplied by the first supply unit and the second supply unit and opening/closure of inlets of the first supply unit and the second supply unit and outlets of the respective discharge units.

13. The drying device according to claim 10, wherein when conveyance of the recording medium in the drying unit is stopped, the gas that is supplied by the second supply unit serves for cooling of the heating unit and the partition member.

14. The drying device according to claim 1, further comprising a discharge unit that discharges the gas supplied by the first supply unit and the second supply unit.

15. The drying device according to claim 14, wherein:

the heating space and the drying space are provided with respective discharge units; and gas flow states in the drying unit are controlling by setting flow rates and flow speeds of the gas supplied by the first supply unit and the second supply unit and opening/closure of inlets of the first supply unit and the second supply unit and outlets of the respective discharge units.

16. The drying device according to claim 14, wherein when conveyance of the recording medium in the drying unit is stopped, the gas that is supplied by the second supply unit serves for cooling of the heating unit and the partition member.

17. The drying device according to claim 1, wherein when conveyance of the recording medium in the drying unit is stopped, the gas that is supplied by the second supply unit serves for cooling of the heating unit and the partition member.

18. An image forming apparatus comprising:

the drying device according to claim 1; and an inkjet image forming unit that forms an image on a recording medium by ejecting droplets onto the recording medium.

* * * * *